US012291679B2

(12) United States Patent
Makowsky et al.

(10) Patent No.: US 12,291,679 B2
(45) Date of Patent: May 6, 2025

(54) PURIFICATION AND CONVERSION PROCESSES FOR ASPHALTENE-CONTAINING FEEDSTOCKS

(71) Applicant: Enlighten Innovations Inc., Calgary (CA)

(72) Inventors: Mykola Makowsky, Menlo Park, CA (US); Michael Zenaitis, Calgary (CA); Joseph Turcotte, Calgary (CA)

(73) Assignee: Enlighten Innovations Inc., Calgary (CA)

( * ) Notice: Subject to any disclaimer, the term of this patent is extended or adjusted under 35 U.S.C. 154(b) by 0 days.

(21) Appl. No.: 17/926,519

(22) PCT Filed: May 19, 2021

(86) PCT No.: PCT/US2021/033105
§ 371 (c)(1),
(2) Date: Nov. 18, 2022

(87) PCT Pub. No.: WO2021/236739
PCT Pub. Date: Nov. 25, 2021

(65) Prior Publication Data

US 2023/0193144 A1 Jun. 22, 2023

Related U.S. Application Data

(60) Provisional application No. 63/027,117, filed on May 19, 2020.

(51) Int. Cl.
*C10G 53/06* (2006.01)
*C25C 3/02* (2006.01)
*C25C 7/00* (2006.01)

(52) U.S. Cl.
CPC ..... *C10G 53/06* (2013.01); *C25C 3/02* (2013.01); *C25C 7/005* (2013.01);
(Continued)

(58) Field of Classification Search
CPC ..... G16B 20/00; G16B 20/20; G16B 20/40; G16B 30/00; C10G 2300/1077;
(Continued)

(56) References Cited

U.S. PATENT DOCUMENTS 8,088,270 B2 1/2012 Gordon et al.
10,435,631 B2 10/2019 Zenaitis et al.
(Continued)

FOREIGN PATENT DOCUMENTS

WO WO-2018067753 A1 * 4/2018 ..... C01B 17/22

OTHER PUBLICATIONS

U.S. Appl. No. 62/985,287, filed Mar. 4, 2020.
(Continued)

*Primary Examiner* — Ellen M McAvoy
*Assistant Examiner* — Chantel Graham
(74) *Attorney, Agent, or Firm* — Foley & Lardner LLP

(57) ABSTRACT

The present technology provides a process comprising: contacting a hydrocarbon feedstock with an effective amount of sodium metal and an effective amount of exogenous capping agent at a temperature of 250-500° C., to produce a mixture of sodium salts and a converted feedstock, wherein the hydrocarbon feedstock comprises hydrocarbons with a sulfur content of at least 0.5 wt % and an asphaltene content of at least 1 wt %; the sulfur content comprises asphaltenic sulfur and non-asphaltenic sulfur; the converted feedstock comprises hydrocarbon oil with a sulfur content less than that in the hydrocarbon feedstock and an asphaltene content less than that in the hydrocarbon feedstock; and the proportion of asphaltenic sulfur to non-asphaltenic sulfur in the converted feedstock is lower than in the hydrocarbon feedstock.

24 Claims, 3 Drawing Sheets

(52) U.S. Cl.
CPC ..... *C10G 2300/1077* (2013.01); *C10G 2300/202* (2013.01); *C10G 2300/205* (2013.01); *C10G 2300/206* (2013.01); *C10G 2300/302* (2013.01); *C10G 2300/308* (2013.01); *C10G 2300/4006* (2013.01); *C10G 2300/4012* (2013.01)

(58) Field of Classification Search
CPC ..... C10G 2300/202; C10G 2300/205; C10G 2300/206; C10G 2300/302; C10G 2300/308; C10G 2300/4006; C10G 2300/4012; C10G 29/04; C10G 53/06; C25C 3/02; C25C 7/005; H02K 53/00; Y10S 74/09
See application file for complete search history.

(56) References Cited

U.S. PATENT DOCUMENTS

2009/0134059 A1* 5/2009 Myers ..... C10G 29/04 208/228
2013/0140217 A1* 6/2013 Gordon ..... C10G 50/00 208/254 R

OTHER PUBLICATIONS

Ancheyta, et al., "Changes in Asphaltene Properties during Hydrotreating of Heavy Crudes" Energy and Fuels, 2003, 17, 1233-1238.
International Search Report and Written Opinion dated Aug. 25, 2021 (14 pages).
Speight, J.G, "Petroleum Asphaltenes Part 1: Asphaltenes, Resins and the Structure of Petroleum", Oil & Gas Science and Technology—Rev IFP, vol. 59 (2004) pp. 467-477.

* cited by examiner

PURIFICATION AND CONVERSION PROCESSES FOR ASPHALTENE-CONTAINING FEEDSTOCKS

CROSS REFERENCE TO RELATED APPLICATIONS

The present application claims priority to U.S. Provisional Application Number filed on 63/027,117 filed on May 19, 2020, the contents of which are incorporated herein in their entirety.

FIELD OF THE TECHNOLOGY

The present technology relates to processes for reducing sulfur and asphaltene content in hydrocarbon feedstocks as well as other impurities. The present technology further relates to processes that preferentially remove sulfur from asphaltenic sulfur species versus other sulfur-containing species in the feedstocks. Still further, the present technology relates to processes that convert at least a portion of the asphaltenes in the feedstocks to hydrocarbon oils.

FIELD OF THE TECHNOLOGY

The present technology relates to processes for reducing sulfur and asphaltene content in hydrocarbon feedstocks as well as other impurities. The present technology further relates to processes that preferentially remove sulfur from asphaltenic sulfur species versus other sulfur-containing species in the feedstocks. Still further, the present technology relates to processes that convert at least a portion of the asphaltenes in the feedstocks to hydrocarbon oils.

BACKGROUND OF THE TECHNOLOGY

Hydrocarbon oils, including many oil feedstocks, often contain difficult-to-remove impurities such as sulfur in the form of organosulfur compounds as well as metals and other heteroatom-containing compounds that hinder usage of the hydrocarbons. The undesired impurities present in hydrocarbon oils can be concentrated in the resins and asphaltenes found in the vacuum residue distillation fraction, generally defined by a boiling point of 510° C. to 565° C. (950° F. to 1050° F.) or greater. Traditional refining configurations further concentrate the undesired impurities by separating the high value, low boiling point distillation fractions (gasoline, diesel, jet, and gasoils) from the low value, high boiling point bottoms fractions (atmospheric and vacuum residues). The low boiling point distillation fractions can be easily treated and converted into finished products using established processes such as hydrotreating, alkylation, catalytic reforming, catalytic cracking and the like. High boiling point residuum streams cannot be easily treated because the disproportionately high metals content fouls catalysts and the polyaromatic structure of the asphaltenes hinders access to impurities.

The sulfur species present in hydrocarbons can be characterized as asphaltenic sulfur (i.e., sulfur-containing asphaltene species) and non-asphaltenic sulfur (i.e., sulfur-containing species). Non-asphaltenic sulfur typically includes thiols, sulfides, benzothiophene, among others, and is primarily located in the vacuum residuum fraction, but may also be present in the saturates, aromatics and resin components located in any distillation fraction. These sulfur species, especially those located within the gasoline, naphtha, kerosene, diesel, and gasoil fractions, can generally be removed using conventional catalytic treatment or conversion processes such as hydrotreating, hydrodesulfurization or hydrocracking. Asphaltenic sulfur, located in the asphaltenes within the heaviest residuum distillation fraction, is primarily characterized by layers of condensed, sulfur-containing polynuclear aromatic compounds linked by saturated species and sulfur. Dibenzothiophene (DBT) and DBT derivatives and sulfur bridges may account for a large proportion of the asphaltenic sulfur species. Additionally, metals, including nickel, vanadium and iron, are often concentrated within porphyrin metal complexes located in the asphaltene fraction. Sulfur cannot be easily removed from asphaltenes without subjecting the asphaltenic sulfur to severe operating conditions.

Residuum thermal or catalytic conversion units operate under severe operating conditions, typically high temperatures (>350° C./662° F.), high hydrogen partial pressures (500-3000 psig) and with specialized catalysts that are deactivated by metals and coke deposition. The difficulty of processing feedstocks with a high asphaltene content in catalytic processes is illustrated by hydrotreating, where it has been found that asphaltenes reduce the rate of hydrotreating reactions, precipitate on the catalyst surface, act as coke precursors and deactivate catalysts. Ancheyta, et al., "Changes in Asphaltene Properties during Hydrotreating of Heavy Crudes" *Energy and Fuels,* 2003, 17, 1233-1238. In the foregoing study, this traditional catalytic process only reduced the asphaltenic sulfur content by 10% while concentrating the metals. Thus, even after subjecting the residuum streams to the most severe operating conditions, a fraction of sulfur and metals is not removed and remains in the oil. As a result, low value residuum bottoms streams are either 1) converted into asphalt, 2) processed in a thermal conversion unit (like a coker) to extract as many high value intermediates as possible or 3) blended into high sulfur bunker fuel.

BRIEF SUMMARY OF THE TECHNOLOGY

Surprisingly, processes for preferentially removing the sulfur and metals from asphaltenes and/or converting a portion of the asphaltene fraction in hydrocarbon feedstocks and residual feedstocks into liquid hydrocarbon products other than asphaltene have been discovered. The processes provide a converted feedstock with a reduced sulfur (and other heteroatom) content and a reduced metals content, especially within the asphaltene fraction. Additionally, pretreating the hydrocarbon feedstock to concentrate impurities in the residual feedstock may be preferred to improve the overall efficiency of the refinery by removing impurities using the most optimal process. Using the present technology, impurities concentrated in an asphaltene fraction of a hydrocarbon or residual feedstock may be best removed by contacting such feeds with sodium metal while impurities concentrated elsewhere may be best removed by traditional refining processes. Furthermore, the operation of downstream process units may be optimized by reducing the high concentration of impurities within the asphaltene fraction, resulting in improved refinery operability and profitability.

Thus, in one aspect, the present technology provides a process comprising: contacting a hydrocarbon feedstock with an effective amount of sodium metal and an effective amount of exogenous capping agent at a temperature of 250-500° C., to produce a mixture of sodium salts and a converted feedstock, wherein the hydrocarbon feedstock comprises hydrocarbons with a sulfur content of at least 0.5 wt % and an asphaltene content of at least 1 wt %; the sulfur content comprises asphaltenic sulfur and non-asphaltenic sulfur; the converted feedstock comprises hydrocarbon oil with a sulfur content less than that in the hydrocarbon feedstock, an asphaltene content less than that in the hydrocarbon feedstock, or both; and the proportion of asphaltenic sulfur to non-asphaltenic sulfur in the converted feedstock is lower than in the hydrocarbon feedstock.

In a second aspect, the present technology provides processes comprising: pretreating a hydrocarbon feedstock comprising impurities to provide a purified feedstock and a residual feedstock, wherein the purified feedstock comprises a lower concentration of impurities than the hydrocarbon feedstock before pretreatment, the residual feedstock comprises a higher concentration of impurities than the purified feedstock; and contacting the residual feedstock with an effective amount of sodium metal and an effective amount of exogenous capping agent at a temperature of 250-500° C., to produce a mixture of sodium salts and a converted feedstock, wherein the residual feedstock comprises hydrocarbons with a sulfur content of at least 0.5 wt % and an asphaltene content of at least 1 wt %; the sulfur content comprises asphaltenic sulfur and non-asphaltenic sulfur; the converted feedstock comprises hydrocarbon oil with a sulfur content less than that in the residual feedstock, an asphaltene content less than that in the residual feedstock, or both; and the proportion by weight of asphaltenic sulfur to non-asphaltenic sulfur in the converted feedstock is lower than in the residual feedstock.

In a third aspect, the present technology provides processes comprising: contacting a residual feedstock, the residual feedstock comprising hydrocarbons with a sulfur content of at least 0.5 wt % and an asphaltene content of at least 1 wt %, with a less than stoichiometric amount of sodium metal to the sulfur content of the residual feedstock, and an effective amount of exogenous capping agent at a temperature of 250-500° C., to produce a mixture of sodium salts and a converted feedstock, wherein the stoichiometric amount of sodium metal to sulfur content is the theoretical amount of sodium metal required to convert all sulfur content in the residual feedstock to sodium sulfide; the converted feedstock comprises a hydrocarbon oil with a sulfur content less than that in the residual feedstock, an asphaltene content less than that in the residual feedstock, or both.

In certain embodiments, the present methods further comprise pretreating a hydrocarbon feedstock to provide a purified feedstock and the residual feedstock, wherein the purified feedstock comprises a lower concentration of impurities than the hydrocarbon feedstock before pretreatment, and the residual feedstock comprises a higher concentration of impurities than the purified feedstock.

In a fourth aspect, the present technology provides processes comprising: pretreating a hydrocarbon feedstock comprising impurities to provide a purified feedstock and a residual feedstock, wherein the purified feedstock comprises a lower concentration of impurities than the hydrocarbon feedstock before pretreatment, and the residual feedstock comprises impurities at a higher concentration than in the purified feedstock; contacting the residual feedstock with an effective amount of sodium metal and an effective amount of exogenous capping agent at a temperature of 250-500° C., to produce a mixture of sodium salts and a converted feedstock, wherein the residual feedstock comprises hydrocarbons with a sulfur content of at least 0.5 wt % and an asphaltene content of at least 1 wt %, the converted feedstock comprises a converted hydrocarbon oil with a sulfur content less than that in the residual feedstock, an asphaltene content less than that in the residual feedstock, or both, and at least a portion of the converted hydrocarbon oil derives from asphaltenes in the residual feedstock.

In any embodiments, the pretreatment step may comprise phase separation by an externally applied field, separation by addition of heat, hydroconversion, thermal conversion, catalytic conversion, catalytic treatment, solvent extraction, solvent deasphalting or a combination of any two or more thereof. In any embodiments, the pretreatment step may comprise contacting the hydrocarbon feedstock with exogenous hydrogen and/or a catalyst to remove one or more of sulfur, nitrogen, oxygen, metals and asphaltenes.

In any embodiments of the present processes, the hydrocarbon feedstock may be or may be derived from a virgin crude oil or a product of a thermal cracking process. Thus, the hydrocarbon feedstock may be selected from the group consisting of conventional crude oil, petroleum, heavy oil, bitumen, shale oil, and oil shale.

In any embodiments of the present processes, the sulfur content of the hydrocarbon feedstock or the residual feedstock may be at least 0.5 wt %, at least 1 wt %, or may range from 0.5 wt % to 15 wt %. In any embodiments of the present processes, the asphaltene content may range from 1 wt % to 100 wt %. For example, the asphaltene content may range from 2 wt % to 40 wt %.

In any embodiments of the present processes, the residual feedstock may comprise one or more of refinery intermediate streams, hydrocracker residue, hydroprocessing residue, FCC slurry, residual FCC slurry, atmospheric or vacuum residuums, solvent deasphalting tar, deasphalted oil, visbreaker tar, high sulfur fuel oil, low sulfur fuel oil, asphaltenes, asphalt, steam cracked tar, LC-Fining® residue, or H-Oil® residue. In any embodiments of the present processes, the hydrocarbon feedstock or the residual feedstock may have a viscosity from 1 to 10,000,000 cSt at 50° C. and a density of 800 to 1200 kg/m$^3$ at 15.6° C. For example, the hydrocarbon feedstock or the residual feedstock may have a viscosity from 400 to 9,000,000 cSt at 50° C. The residual feedstock may also be a solid at room temperature.

In any embodiments of the present processes, the residual feedstock may have a higher concentration of impurities than the hydrocarbon feedstock. In any embodiments, the sulfur content may comprise asphaltenic sulfur and non-asphaltenic sulfur, and the proportion of asphaltenic sulfur to non-asphaltenic sulfur in the converted feedstock may be lower than in the residual feedstock.

In any embodiments of the present processes, the viscosity of the converted feedstock may be reduced by at least 50 cSt at 50° C. or at least by 40%, and the density of the converted feedstock may be reduced by about 5 to about 25 kg/m$^3$ per wt % of the reduction in sulfur content of the converted feedstock compared to the hydrocarbon feedstock or residual feedstock. In any embodiments, the iron and vanadium content of the converted feedstock may be reduced by at least 40% compared to the hydrocarbon feedstock or residual feedstock. In any embodiments, the nickel content of the converted feedstock may be reduced by at least 40% compared to the hydrocarbon feedstock or residual feedstock.

In any embodiments of the present processes, at least 40% of the asphaltene content in the residual feedstock may be converted to a liquid hydrocarbon oil in the converted feedstock. In any embodiments, the asphaltene content may be converted at least in part to paraffins.

In any embodiments of the present processes, the exogenous capping agent may be hydrogen, hydrogen sulfide, natural gas, methane, ethane, propane, butane, pentane, ethene, propene, butene, pentene, dienes, isomers of the forgoing or a mixture of any two or more thereof. In any embodiments, the residual feedstock may be combined with sodium metal at a pressure of about 500 psig to about 3000 psig. In any embodiments, the reaction of residual feedstock with sodium metal may occur for a time from 1 minute to 120 minutes.

In any embodiments of the present processes, the sodium salts may comprise one or more of sodium sulfide, sodium hydrosulfide, or sodium polysulfide.

In any embodiments of the present processes, the processes may further comprise separating the sodium salts from the converted feedstock. The separating may comprise (a) heating the mixture of sodium salts and converted feedstock with elemental sulfur to a temperature from about 150° C. to 500° C. to provide a sulfur-treated mixture comprising agglomerated sodium salts; and (b) separating the agglomerated sodium salts from the sulfur treated mixture, to provide a desulfurized liquid hydrocarbon and separated sodium salts.

In any embodiments, the present processes may comprise electrolyzing the separated sodium salts to provide sodium metal. In any embodiments the electrolyzing is carried out in an electrochemical cell comprising an anolyte compartment, a catholyte compartment, a NaSICON membrane that separates the anolyte compartment from the catholyte compartment, wherein a cathode comprising sodium metal is disposed in a catholyte in the catholyte compartment, an anode comprising the sodium salts are disposed in anolyte in the anolyte compartment, and an electrical power supply is electrically connected to the anode and cathode.

The foregoing is a summary of the disclosure and thus by necessity contains simplifications, generalizations, and omissions of detail. Consequently, those skilled in the art will appreciate that the summary is illustrative only and is not intended to be in any way limiting. Other aspects, features, and advantages of the processes described herein, as defined by the claims, will become apparent in the detailed description set forth herein and taken in conjunction with the accompanying drawings.

BRIEF DESCRIPTION OF THE DRAWINGS

In order that the manner in which the above-recited and other features and advantages of the technology are obtained will be readily understood, a more particular description of the technology briefly described above will be rendered by reference to specific embodiments thereof that are illustrated in the appended drawings. Understanding that these drawings depict only typical embodiments of the technology and are not therefore to be considered to be limiting of its scope, the technology will be described and explained with additional specificity and detail through the use of the accompanying drawings in which.

DETAILED DESCRIPTION OF THE TECHNOLOGY

Figure 1:
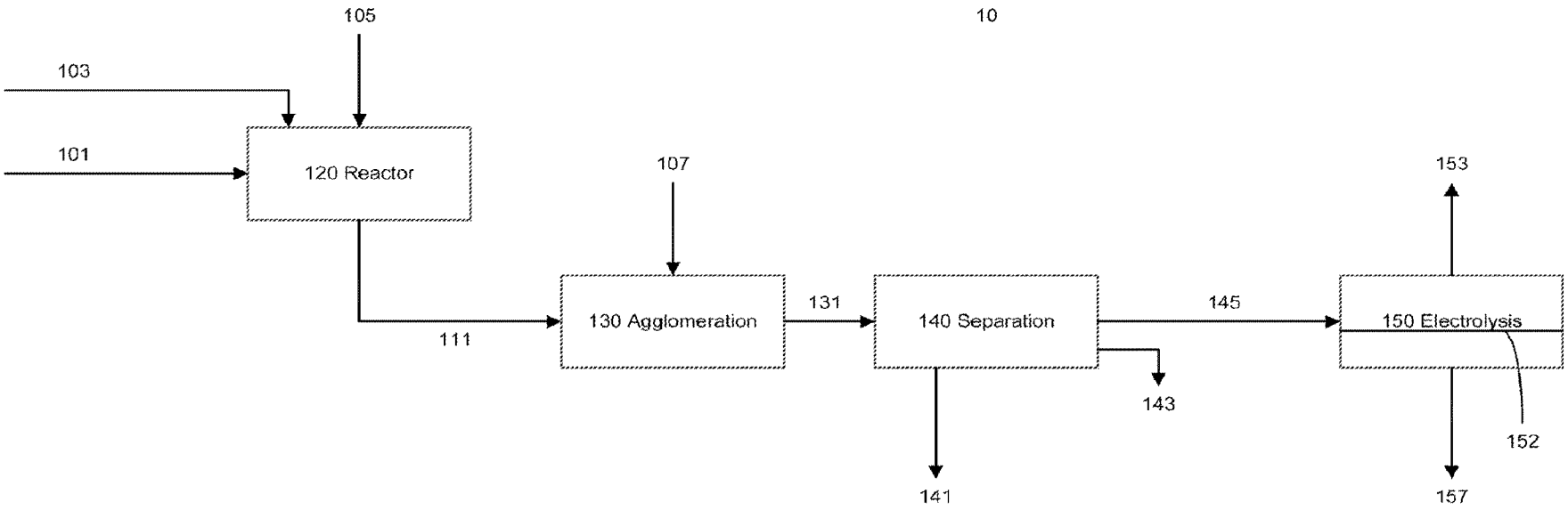
FIG. 1 is a flow diagram for an illustrative embodiment of a process of the present technology.

The following terms are used throughout as defined below.

As used herein, singular articles such as "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

As used herein, "asphaltenes" refers to the constituents of oil that are insoluble in n-pentane. Asphaltenes may include polyaromatic molecules that comprise one or more heteroatoms selected from S, N, and O. Sulfur species found in asphaltenes are collectively referred to herein as "asphaltenic sulfur." All other sulfur species found in the non-asphaltenic fractions of hydrocarbon oils and fractions thereof, are collectively referred to herein as "non-asphaltenic sulfur." The latter include, e.g., thiols, sulfates, thiophenes, including benzothiophenes, hydrogen sulfide and other sulfides. The sulfur content of any feedstock, including but not limited to purified feedstocks, residual feedstocks, and converted feedstocks, comprises asphaltenic sulfur and non-asphaltenic sulfur.

As used herein, "hydrocarbon feedstocks" refers to any material that may be an input for refining, conversion or other industrial process in which hydrocarbons are the principal constituents. Hydrocarbon feedstocks may be solid or liquid at room temperature and may include non-hydrocarbon constituents such as heteroatom-containing (e.g., S, N, O, P, metals) organic and inorganic materials. Crude oils, refinery streams, chemical plant streams (e.g. steam cracked tar) and recycling plant streams (e.g., lube oils and pyrolysis oil from tires or municipal solid waste) are non-limiting examples of hydrocarbon feedstocks.

The present technology provides an upgrading process for hydrocarbon feedstocks, including residual feedstocks, to produce a converted feedstock with reduced concentrations of impurities. Surprisingly, it has been found that the present processes preferentially reduce the asphaltenic sulfur content of the starting feedstocks compared to the non-asphaltenic sulfur content. This is the reverse of commercially used upgrading or desulfurization processes and allows for much more efficient use of asphaltene-containing feedstocks. Thus, in a first aspect the process includes contacting a hydrocarbon feedstock with an effective amount of sodium metal and an effective amount of exogenous capping agent at a temperature of 250-500° C., to produce a mixture of sodium salts and a converted feedstock. The hydrocarbon feedstock of the present processes include hydrocarbons with a sulfur content of at least 0.5 wt % (herein, "wt %" means "weight percent") and an asphaltene content of at least 1 wt %. The sulfur content incudes asphaltenic sulfur and non-asphaltenic sulfur. The converted feedstock comprises a hydrocarbon oil with a sulfur content less than that in the hydrocarbon feedstock. In any embodiments, the converted feedstock further includes an asphaltene content less than that in the hydrocarbon feedstock. Additionally, the proportion of asphaltenic sulfur to non-asphaltenic sulfur in the converted feedstock is lower than in the hydrocarbon feedstock.

In a second aspect, the present technology provides a process including pretreating a hydrocarbon feedstock comprising impurities to provide a purified feedstock and a residual feedstock. The purified feedstock includes a lower concentration of impurities than the hydrocarbon feedstock before pretreatment, and the residual feedstock comprises a higher concentration of impurities than the purified feedstock. The process further includes contacting the residual feedstock with an effective amount of sodium metal and an effective amount of exogenous capping agent at a temperature of 250-500° C., to produce a mixture of sodium salts and a converted feedstock. The residual feedstock includes hydrocarbons with a sulfur content of at least 0.5 wt % and an asphaltene content of at least 1 wt %. The sulfur content includes asphaltenic sulfur and non-asphaltenic sulfur. The converted feedstock includes hydrocarbon oil with a sulfur content less than that in the residual feedstock. In any embodiments, the converted feedstock further includes an asphaltene content less than that in the hydrocarbon feedstock. Additionally, the proportion by weight of asphaltenic sulfur to non-asphaltenic sulfur in the converted feedstock is lower than in the residual feedstock.

In a third aspect, the present technology provides a process that includes pretreating a hydrocarbon feedstock comprising impurities to provide a purified feedstock and a residual feedstock, wherein the purified feedstock comprises a lower concentration of impurities than the hydrocarbon feedstock before pretreatment, and the residual feedstock comprises impurities at a higher concentration than in the purified feedstock. The process further includes contacting the residual feedstock with an effective amount of sodium metal and an effective amount of exogenous capping agent at a temperature of 250-500° C., to produce a mixture of sodium salts and a converted feedstock. In this aspect, the residual feedstock includes a hydrocarbon oil with a sulfur content of at least 0.5 wt % and an asphaltene content of at least 1 wt %. The converted feedstock includes a converted hydrocarbon oil with a sulfur content less than that in the residual feedstock. In the converted feedstock, at least a portion of the converted hydrocarbon oil derives from asphaltenes in the residual feedstock, and in some embodiments, the asphaltene content of the converted feedstock is less than that in the residual feedstock. In other words, in this process at least some of the asphaltenes in the residual feedstock are converted to hydrocarbon oil. In contrast, most if not all other commercial processes used to reduce asphaltene content only remove asphaltenes from the feed in a form that is either of low or no value (e.g., coke or asphaltenes from solvent deasphalting processes) and which may actually cost money to dispose of or convert to a usable product.

In a fourth aspect, the present technology provides a process that includes contacting a residual feedstock, the residual feedstock including hydrocarbons with a sulfur content of at least 0.5 wt % and an asphaltene content of at least 1 wt %, with a less than stoichiometric amount of sodium metal to the sulfur content of the residual feedstock, and an effective amount of exogenous capping agent at a temperature of 250-500° C., to produce a mixture of sodium salts and a converted feedstock. The converted feedstock includes a hydrocarbon oil with a sulfur content less than that in the residual feedstock. In any embodiments, the converted feedstock may include an asphaltene content less than that in the residual feedstock. In this process, the less than stoichiometric amount of sodium metal to sulfur content is less than the theoretical amount of sodium metal required to convert all sulfur content in the residual feedstock to sodium sulfide (i.e., $Na_2S$).

In any embodiments of the process of the fourth aspect, the process may further include pretreating a hydrocarbon feedstock to provide a purified feedstock and the residual feedstock, wherein the purified feedstock includes a lower concentration of impurities than the hydrocarbon feedstock before pretreatment, and the residual feedstock includes a higher concentration of impurities than the purified feedstock. In any embodiments, the sulfur content comprises asphaltenic sulfur and non-asphaltenic sulfur, and the proportion of asphaltenic sulfur to non-asphaltenic sulfur in the converted feedstock is lower than in the residual feedstock.

In any embodiments of the present processes including a pretreating step (including but not limited to processes of the second, third or fourth aspects), the pretreatment step may include phase separation by an externally applied field, separation by addition of heat, hydroconversion, thermal conversion, catalytic conversion or treatment, solvent extraction, solvent deasphalting or a combination of any two or more thereof. In any embodiments, the pretreatment step may include contacting the hydrocarbon feedstock with exogenous hydrogen and/or a catalyst to remove one or more of sulfur, nitrogen, oxygen, metals and asphaltenes. Examples of pretreatment steps to produce a purified feedstock and a residual feedstock include atmospheric distillation, vacuum distillation, steam cracking, catalytic cracking, thermal cracking, fluid catalytic cracking (FCC), solvent deasphalting, hydrodesulfurization, visbreaking, pyrolysis, catalytic reforming, and alkylation. It will be understood that certain of the foregoing processes, such as atmospheric distillation and vacuum distillation directly yield a purified feedstock and a residual feedstock, while others require a subsequent separation step. For example, steam cracking, catalytic cracking, thermal cracking, FCC and pyrolysis yield a mixture of products that is subsequently separated into a purified feedstock and a residual feedstock by distillation or other separation process.

Hydrocarbon feedstocks for the present processes are or may be derived from virgin crude oils (for example petroleum, heavy oil, bitumen, shale oil and oil shale). Hydrocarbon feedstocks may also be a distillation fraction of a virgin crude oil or product of a thermal cracking process.

Residual feedstocks may be produced from hydrocarbon feedstocks by various pretreatment processes of the present technology and/or may be employed in various processes of the present technology to provide converted feedstocks. Thus, residual feedstocks may include distillation products of hydrocarbon feedstocks, (atmospheric or vacuum residuums, gasoline, diesel, kerosene, and gas oils), and refinery intermediate streams. The refinery intermediate streams may be converted feedstocks (for example, solvent deasphalting tar, steam cracked tar, FCC slurry, visbreaker tar, hydrotreater, hydrocracker or hydroconversion bottoms, coke and asphalt) or treated feedstocks (for example, hydrotreated oils and bunker oil). In any embodiments, the residual feedstock may include hydrotreated products, hydrocracker residue, hydroconversion residue (e.g. LC-Finer® (Chevron Global Lummus) residue, or H-Oil® (Axens) residue), FCC slurry, residual FCC slurry, atmospheric or vacuum residuums, solvent deasphalting tar, deasphalted oil, steam cracked tar, visbreaker tar, high sulfur fuel oil, low sulfur fuel oil, asphaltenes, asphalt and coke. The foregoing hydrocarbon and residual feedstocks may be derived from any geological formation (oil sand, conventional or tight reservoirs, shale oil, oil shale) or geographical location (North America, South America, Middle East, etc.).

In processes of the present technology, the hydrocarbon feedstock includes hydrocarbons (e.g., a hydrocarbon oil) and impurities. Similarly, the residual feedstock includes hydrocarbons and impurities. In some embodiments, the residual feedstock has a higher concentration of impurities than the hydrocarbon feedstock. "Impurities" as used herein refer to heteroatoms (i.e., atoms other than carbon and hydrogen), such as sulfur, oxygen, nitrogen, phosphorous, and metals. Impurities may be found in or include substances such as naphthenic acids, water, ammonia, hydrogen sulfide, thiols, thiophenes, benzothiophenes, porphyrins, Fe, V, Ni, and the like. In any embodiments of the present processes, the hydrocarbon feedstock or residual feedstock includes hydrocarbons with a sulfur content of at least 0.5 wt % and an asphaltene content of at least 1 wt %. The sulfur content comprises asphaltenic sulfur and non-asphaltenic sulfur, but is measured as the wt % of sulfur atoms in the feedstock. In any embodiments, the sulfur content may range from 0.5 wt % to 15 wt %, including for example, 0.5, 1, 1.5, 2, 2.5, 3, 3.5, 4, 4.5, 5, 6, 7, 8, 9, 10, 11, 12, 13, 14, or 15 wt % or a range between and including any two of the foregoing values. Thus, the sulfur content may range may be, in any embodiments, 1 wt % to 15 wt %, 0.5 wt % to 8 wt %, or 1.5 wt % to 10 wt %.

In processes of the present technology, the asphaltene content refers to the total amount of asphaltenes in a feedstock measured as the n-pentane insoluble fraction of the feedstock. However, in some aspects and embodiments of the present processes, the asphaltene content may be measured as the insoluble fraction of the hydrocarbon feedstock or residual feedstock precipitated or otherwise separated from the feedstock, after mixing with a sufficient quantity of one or more $C_{3-8}$ alkanes. The $C_{3-8}$ alkanes may be propane, butane, pentane, hexane, heptane, octane, isomers thereof, or mixtures of any two or more thereof. Thus, in some embodiments, the asphaltene content of a feed may be defined as the constituents insoluble in heptane. By "sufficient quantity," is meant an amount beyond which no further precipitation/separation of insoluble fractions from the hydrocarbon feedstock or residual feedstock is observed. A detailed discussion of the physical properties and structure of asphaltenes and the process conditions (temperatures, pressures, solvent/oil ratios) required to produce a specific asphaltene is described in J. G. Speight, "Petroleum Asphaltenes Part 1: Asphaltenes, Resins and the Structure of Petroleum", *Oil & Gas Science and Technology—Rev IFP*, Vol 59 (2004) pp. 467-477 (incorporated herein by reference in its entirety and for all purposes). The standard test method for determining heptane (C7) insoluble asphaltene content is described by ASTM standard D6560-17 and can be extended to any alkane, including pentane.

In any embodiments of the present processes, the asphaltene content of hydrocarbon feedstock or residual feedstock may be at least 1 wt %, at least 2 wt %, at least 3 wt %, at least 4 wt % or at least 5 wt %. For example, the asphaltene content may range from 1 wt % to 100 wt %, such as 1, 2, 3, 4, 5, 6, 7, 8, 9, 10, 15, 20, 25, 30, 35, 40, 45, 50, 55, 60, 70, 80, 90, 95 or 100 wt % or between and including any two of the foregoing values. Thus, in any embodiments, the asphaltene content may range from 2 wt % to 100 wt %, 1 wt % to 30 wt %, 2 wt % to 30 wt %, 5 wt % to 100 wt %, 10 wt % to 100 wt %, or 20 wt % to 100 wt %.

In any embodiments of the present process, it may be necessary to dilute the hydrocarbon feedstock with a diluent if an elevated asphaltene content in the hydrocarbon feedstock leads to a viscosity that is too high for the sodium treatment process. Because of the aromatic nature of asphaltenes, a diluent will typically include aromatics. This diluent may be a single compound (e.g., benzene, toluene, xylene, ethylbenzene, cumene, naphthalene, 1-methylnaphthalene), mixtures of any two or more thereof, or a refinery intermediate that is aromatic (e.g., light cycle oil, reformate). The amount of diluent needed will vary with the asphaltene content of the feedstock and the viscosity required for processing. Higher asphaltene content in a feedstock may require more diluent than a feedstock with lower asphaltene content. It is within the skill in the art to select an appropriate amount of diluent to permit processing of asphaltenes in the present processes.

The present processes may also reduce/remove the naphthenic acid content and/or the metals content in converted feedstocks compared to the hydrocarbon and residual feedstocks. In any embodiments the hydrocarbon feedstock or residual feedstock includes (on an aggregate or individual basis) about 1 to about 10,000 ppm metals. The metals may be naturally occurring metals bound to the hydrocarbon structure or residual metal fragments entrained in the residual feedstock during upstream processing (e.g., corrosion products or catalyst fragments). In any embodiments, the metal is selected from the group consisting alkali metals, alkali earth metals, transition metals, post transition metals, and metalloids having an atomic weight equal to or less than 82. In any embodiments, the metal is selected from the group of vanadium, nickel, iron, arsenic, lead, cadmium, copper, zinc, chromium, molybdenum, silicon, calcium, potassium, aluminum, magnesium, manganese, titanium, mercury and combinations of any two or more thereof. In any embodiments, the metal is selected from the group consisting of vanadium, nickel, iron, and combinations of any two or more thereof. In any embodiments, the metals concentration of the hydrocarbon feedstock or the residual feedstock may be (in the aggregate or on an individual basis) about 2 to about 10,000 ppm, about 10 to about 10,000 ppm, about 100 to about 10,000 ppm, about 100 to about 5,000 ppm, about 10 to about 1,000 ppm, about 100 to about 1,000 ppm, and the like.

The processes of the present technology not only upgrade the hydrocarbon and residual feedstocks employed by removal/reduction of impurities, but may also improve physical properties such as viscosity and density. The hydrocarbon feedstock or residual feedstock may have a viscosity between 1 to 10,000,000 cSt at 50° C. For example, the viscosity may 1, 10, 25, 50, 100, 200, 300, 400, 500, 1,000, 2,000, 5,000, 10,000, 25,000, 50,000, 100,000, 500,000, 1,000,000, 2,000,000, 3,000,000, 4,000,000, 5,000,000, 6,000,000, 7,000,000, 8,000,000, or 9,000,000 cSt or a range between and including any two of the foregoing values. Thus, in any embodiments, the viscosity of the hydrocarbon feedstock or the residual feedstock may be, e.g., 100 to 10,000,000 cSt, 380 to 9,000,000 cSt, 500 to 9,000,000 cSt, or 500 to 5,000,000 cSt, among others.

The hydrocarbon feedstock or residual feedstock may have a density from 800 to 1200 kg/m$^3$ at 15.6° C. or 60° F. For example, the density may be 800, 825, 850, 875, 900, 925, 975, 1000, 1050, 1100, 1150, or 1200 kg/m$^3$ or a range between and including any two of the foregoing values. Thus, in any embodiments, the density may be, e.g., from 850 to 1200 kg/m$^3$, 900 to 1200 kg/m$^3$, 950 to 1200 kg/m$^3$, or 925 to 1100 kg/m$^3$.

In processes of the present technology, the hydrocarbon feedstock or residual feedstock is contacted with an effective amount of sodium metal and an effective amount of exogenous capping agent. Any suitable source of sodium metal may be used, including, but not limited to electrochemically generated sodium metal, e.g., as described in U.S. Pat. No. 8,088,270, incorporated by reference in its entirety herein.

The exogenous capping agent used in the present processes is typically used to cap the radicals formed when sulfur and other heteroatoms have been abstracted by the sodium metal during the contacting step. Although some feedstocks may inherently contain small amounts of naturally occurring capping agents ("endogenous capping agents"), such amounts are insufficient to cap substantially all of the free radicals generated by the present processes. Effective amounts of exogenous (i.e., added) capping agents are used in the present processes, such as 1-1.5 moles of capping agent (e.g., hydrogen) may be used per mole of sulfur, nitrogen, or oxygen present. It is within the skill of the art to determine an effective amount of exogenous capping agent needed to carry out the present processes for the particular hydrocarbon feedstock or residual feedstock being used based on the disclosure herein. The exogenous capping agent may include hydrogen, hydrogen sulfide, natural gas, methane, ethane, propane, butane, pentane, ethene, propene, butene, pentene, dienes, isomers of the forgoing or a mixture of any two or more thereof. In any embodiments, the exogenous capping agent may be hydrogen and/or a $C_{1-6}$ acyclic alkanes and/or $C_{2-6}$ acyclic alkene or a mixture of any two or more thereof.

The effective amount of sodium in its metallic state and used in the contacting step will vary with the level of heteroatom, metal, and asphaltene impurities of the hydrocarbon and residual feedstocks, the desired extent of conversion or removal of an impurity, the temperature used and other conditions. In any embodiments, stoichiometric or greater than stoichiometric amounts of sodium metal may be used to remove all or nearly all sulfur content, e.g., 1-3 mole equivalents of sodium metal versus sulfur content. In any embodiments, the hydrocarbon feedstock or residual feedstock is contacted with more than 1 mole equivalent of sodium metal versus the sulfur content therein, e.g., 1.1, 1.15, 1.2, 1.25, 1.3, 1.4, 1.5, 2, 2.5 or 3 mole equivalents of sodium metal.

Surprisingly, a sub-stoichiometric ratio of metallic sodium to sulfur content (in the hydrocarbon/residual feedstocks) may be used to preferentially lower the amount of asphaltenic sulfur versus the non-asphaltenic sulfur. Thus, in any embodiments, the residual feedstock (or alternatively the hydrocarbon feedstock) may be contacted with a less than stoichiometric amount of sodium metal to the sulfur content therein. In the present technology, it will be understood that the stoichiometric amount of sodium metal to sulfur content is the theoretical amount of sodium metal required to convert all sulfur content in the residual (or hydrocarbon) feedstock to sodium sulfide. For example, it will be appreciated by those of skill in the art that the stoichiometric amount of sodium metal necessary to convert all of the sulfur to sodium sulfide in a feedstock containing about 1 mole of sulfur atoms is 2 moles of sodium metal. A less than stoichiometric amount of sodium metal to sulfur content in such an example would be less than 2 moles of sodium metal, such as 1.6 moles, which would be 0.8 mole equivalents of sodium metal. In any embodiments, the less than stoichiometric amount of sodium metal to sulfur content may be 0.1 equivalents to less than 1 equivalent. Examples of such sub-stoichiometric amounts include 0.1, 0.2, 0.3, 0.4, 0.5, 0.6, 0.7, 0.8, 0.9 or less than 1 equivalents of sodium metal to sulfur content or a range between and including any two of the foregoing values. Thus, in any embodiments the sub-stoichiometric amounts may range from 0.1 to 0.9 equivalents, 0.2 to 0.8 equivalents, 0.4 to 0.8 equivalents, or the like.

As the contacting step takes place at a temperature of about 250° C. to about 500° C., the sodium metal will be in a molten (i.e., liquid) state. For example, the contacting step may be carried out at about 250° C., about 275° C., about 300° C., about 325° C., about 350° C., about 375° C., about 400° C., about 425° C., about 450° C., about 500° C., or a range between and including any two of the foregoing temperatures. Thus, in any embodiments the contacting may take place at about 275° C. to about 425° C., or about 300° C. to about 400° C. (e.g., at about 350° C.).

In any embodiments, the contacting step may take place at a pressure of about 400 to about 3000 psi, e.g., at about 400 psi, about 500 psi, about 600 psi, about 750 psi, about 1000 psi, about 1250 psi, about 1500 psi, about 2000 psi, about 2500 psi, about 3000 psi or a range between and including any two of the foregoing values.

The reaction of sodium metal with heteroatom contaminants in the hydrocarbon/residual feedstocks is relatively fast, being complete within a few minutes, if not seconds. Mixing the combination of feedstock and metallic sodium further speeds the reaction and is commonly used for this reaction on the industrial scale. However, certain embodiments may require an extended residence time to improve the extent of conversion or adjust the operating conditions to target removal of a specific heteroatom impurity. Hence, in any embodiments the contacting step is carried out for about 1 minute to about 120 minutes, e.g., about 1, about 5, about 7, about 9, about 10, about 15 minutes, about 30, about 45 about 60, about 75, about 90, about 105, or about 120 minutes, or is conducted for a time ranging between and including any two of the foregoing values. Thus, in any embodiments the time may range from about 1 to about 60 minutes, about 5 minutes to about 60 minutes, about 1 to about 15 minutes, about 60 minutes to 120 minutes, or the like.

The present processes produce a converted feedstock that includes a hydrocarbon oil with a sulfur content less than that in the hydrocarbon feedstock (or residual feedstock). In any embodiments, the sulfur content of the converted feedstock may be less than 0.5 wt %, e.g., less than or about 0.4 wt %, less than or about 0.3 wt %, less than or about 0.2 wt %, less than or about 0.1 wt %, and even less than or about 0.05 wt %, or a range between and including any two of the foregoing values. In any embodiments where the sulfur is particularly hard to remove or a less than stoichiometric amount of sodium is used (see below), the sulfur content of the converted feedstock may be less than 2 wt %, less than 1.8 wt %, less than 1.6 wt %, less than 1.4 wt %, less than 1.2 wt %, less than 1 wt %, less than 0.8 wt %, less than 0.6 wt %, or a range between and including any two of the foregoing values. In some embodiments, the sulfur content of the converted feedstock is less than 1 wt %. Removal efficiency of the sulfur content (a.k.a., conversion efficiency)

from the hydrocarbon or residual feedstock compared to the converted feedstock may be at least 40%, at least 50%, at least 60%, at least 70%, at least 80%, at least 90%, at least 95%, at least 96%, at least 97%, at least 98%, at least 99% or 100% by weight, or a range between and including any two of the foregoing values, e.g., from 40% to 99%, or from 40% to 95%. Where the effective amount of sodium metal is greater than a stoichiometric amount, the sulfur content conversion efficiency can be very high, e.g., at least 90%.

When sub-stoichiometric amounts of sodium metal are used in the present processes (including but not limited to processes of the first, second, third and fourth aspects), lower conversion efficiencies are observed, but the sulfur content from asphaltenic sulfur is preferentially reduced compared to that from non-asphaltenic sulfur. For example, the (total) sulfur content conversion efficiency may range from about 10% to about 80%, including, about 10%, about 20%, about 30%, about 40%, about 50%, about 60%, about 70%, about 80%, or a range between and including any two of the foregoing values. At the same time, the corresponding sulfur content conversion efficiency of asphaltenic sulfur is higher at each point than the total sulfur-conversion efficiency. For example sulfur content conversion efficiency of asphaltenic sulfur for any given feed may range from 1% to 40% higher (e.g., 1%, 2%, 3%, 4%, 5%, 6%, 7%, 8%, 9%, 10%, 11%, 12%, 13%, 14%, 15%, 16%, 17%, 18%, 19%, 20%, 22%, 24%, 25%, 27%, 30%, 32%, 35%, 37%, or 40% higher or a range between and including any two of the foregoing values) than the corresponding overall sulfur content conversion efficiency.

The converted feedstocks of the present technology have a reduced concentration of metals compared to the hydrocarbon or residual feedstocks. The metals content of the converted feedstock may be reduced by at least 20% compared to the hydrocarbon feedstock or residual feedstock, for example, by 20% to 100%. Examples of the percent reduction in metals (collectively or individually) in the converted feedstock compared to the hydrocarbon feedstock or the residual feedstock include 20%, 30%, 40%, 50%, 60%, 70%, 80%, 90%, 95%, 97%, 98%, 99%, 100%, or a range between and including any two or more of the foregoing values. Thus, in any embodiments the percent reduction may be from 20% to 99%, from 20% to 95%, from 70% to 99% or to 100%. The metals may be any of those disclosed herein. In some embodiments, the metals are selected from iron, vanadium, nickel or combinations of any two or more thereof. For example, the iron and vanadium content of the converted feedstock has been reduced by at least 20% compared to the hydrocarbon feedstock or residual feedstock. Similarly, in any embodiments, the nickel content of the converted feedstock has been reduced by at least 20% compared to the hydrocarbon feedstock or residual feedstock.

The present processes also provide converted feedstocks with improved physical properties compared to the hydrocarbon feedstock or residual feedstock. However, it has been discovered that the physical properties of converted feedstocks of the present processes do not necessarily change proportionately to the sodium to sulfur ratio. For example, the extent of metals demetallization, especially metals detrimental to catalyst life including iron, vanadium and nickel will generally be greater than the extent of desulfurization for a given sodium to sulfur ratio. Example 6 demonstrates the insensitivity of sodium treatment to initial metals content, unlike catalytic conversion processes. Sodium demetallization at low sodium/total sulfur addition ratio could be highly advantageous for pre-treating a hydrocarbon feed with an undesirably high metals content prior to catalytic conversion or treatment.

Additional physical properties that greatly reduce the value of heavy residual feedstocks are improved after treatment with sodium. Desulfurization of the asphaltene fraction occurs without the hydrogen saturation observed in hydroconversion or the carbon rejection exhibited by thermal cracking processes. As a result, at least a portion of the asphaltene content is converted by the present processes into a soluble, stable and desulfurized converted liquid product, increasing the yield of higher value liquid products (e.g., hydrocarbon oils derived from asphaltenes. Thus, the converted feedstock produced by the present processes may have an asphaltene content less than that in the hydrocarbon feedstock (or residual feedstock). In any embodiments, the present processes convert at least some asphaltenes to a hydrocarbon oil, such as paraffins. In any embodiments, at least 5%, at least 10%, at least 15%, at least 20% or more of the asphaltene content in the residual feedstock is converted to a liquid hydrocarbon oil in the converted feedstock. Conversion efficiency for the asphaltene content removed from the hydrocarbon or residual feedstocks varies with the amount of sodium used, but is generally high, e.g., at least 70%, at least 75%, at least 80%, at least 85%, at least 90%, at least 95%, up to 98%, up to 99% or even up to 99.9% or 100%, or a range between and including any two of the foregoing values (e.g., 70% to 100%, or 75% to 99.9%, etc.).

The conversion of asphaltenes to smaller, lower molecular weight components with fewer attached functional groups typically results in a reduction in viscosity of at least 40% to as much as 5 orders of magnitude (10000×) and an increase in the API gravity by about 1 to about 3 units for each wt % sulfur removed. In any embodiments, the viscosity of the converted feedstock may be reduced by at least 50 cSt at 50° C. or by at least 40%. In any such embodiments, the viscosity is reduced at 50° C. by at least 100 cSt, at least 200 cSt, at least 300 cSt, or more. For any of the hydrocarbon feedstocks or residual feedstocks disclosed herein with viscosities above 1,000 cSt (see above), the reductions are particularly great and may be at least 50%, at least 60%, at least 70%, at least 80%, at least 90%, at least 95%, at least 99%, or even 100% (e.g., at least a 40 to 99% reduction in viscosity. In any embodiments, the density of the converted feedstock is decreased by about 5 to about 25 $kg/m^3$ per wt % reduction in sulfur content of the converted feedstock compared to the hydrocarbon feedstock or residual feedstock. For example, the decrease in density may be about 5, about 10, about 15, about 20, about 25 $kg/m^3$ or a range between and including any two of the foregoing values (such as about 5 to about 20 $kg/m^3$ or about 10 to about 25 $kg/m^3$, etc.).

As noted above, in any embodiments, the present processes may include pretreating a hydrocarbon feedstock containing impurities prior to contacting with sodium metal. In some cases, a hydrocarbon feedstock may be pretreated to concentrate the impurities in the residual feedstock and therefore reduce the volume of feedstock to process. For example, a virgin crude oil may be distilled to produce one or more light distillate cuts as the purified feedstock and an atmospheric residuum (the residual feedstock) with a higher sulfur content and higher asphaltene content than that in both the purified feedstock and the virgin crude (hydrocarbon feedstock). Alternatively, a hydrocarbon feedstock may be pre-treated to remove a portion of the undesired impurities to provide for a purified feedstock with a lower concentration of impurities and a residual feedstock with impurities that remain after pre-treatment. The residual feedstock may comprise impurities because of the chosen level of conversion or because the pre-treatment process cannot remove the impurity. For example, a vacuum residuum may be treated in a hydroprocessing reactor (such as an LC-Fining® unit or H-Oil® unit) to remove sulfur and convert the residuum fraction to higher value products. However, after hydroprocessing at operating conditions exceeding 350° C. and 1500-3000 psig in the presence of catalysts, a recalcitrant sulfur and asphaltene fraction remains in the hydroprocessed bottoms stream. The pre-treatment process may comprise a separation process, a thermal or catalytic conversion process or a treatment process, or combinations of any two or more thereof.

In any embodiments, the pretreatment process may include a separation process that comprises one or more of a physical separation using energy (heat), phase addition (solvent or absorbent), a change in pressure, or application of an external field or gradient to concentrate the impurity in the residual feedstock. The separation process may include gravity separation, flash vaporization, distillation, condensation, drying, liquid-liquid extraction, stripping, absorption, centrifugation, electrostatic separation and their variants. The separation process may further comprise solvent extraction processes, including solvent deasphalting processes, such as Residuum Oil Supercritical Extraction (ROSE®). For example, a hydrocarbon feedstock may be desalted to remove salt and water, an API separator may be used to separate water and solids from oil or a distillation column may be used to separate low sulfur, low boiling point products from high sulfur, high boiling point products in crude oil. The separation process may also require a solid agent or barrier, such as adsorption, filtration, osmosis or their variants. Each of the disclosed separation processes results in a purified feedstock with a lower concentration of impurities than the hydrocarbon feedstock and a residual feedstock with a higher concentration of impurities than the purified feedstock. In any embodiments, the residual feedstock comprises impurities at a higher concentration than in the hydrocarbon feedstock. In any embodiments, the pre-treatment process further provides a gaseous impurities stream (e.g., $H_2S$, water, $NH_3$ and light hydrocarbon gases such as methane, ethane and propane). Such gaseous impurities may be removed using an absorption process, sulfur recovery process, or other processes known in the art.

In any embodiments, the pretreatment process may include thermal or catalytic processes that modify the molecular structure or result in rejection of at least a portion of the carbon content of the hydrocarbon feedstock. The thermal conversion process may include a coker, a visbreaker or other process to increase the yield of cracked distillates by rejecting carbon as coke. The catalytic processes may include fixed bed and fluidized bed processes such as, but not limited to catalytic crackers (FCC or Residuum FCC), hydrocrackers, residuum hydrocrackers and hydroconversion (e.g., LC Fining®, H-Oil®). The conversion process may be a hydroprocessing process that requires both hydrogen and catalysts.

The pretreatment step of the present processes may include a treatment process that results in hydrocarbon saturation or removal of a specific impurity on a whole feed basis. Thus, in any embodiments, the pretreating process may include solvent deasphalting, hydrotreating, residuum hydrotreating (RHT), hydrodesulfurization (RDS), hydrodemetallization (HDM) or hydrodenitrification (HDN) or a combination of two or more thereof. While the overall concentration of an impurity (or impurities) may be reduced, treatment processes generally produce a purified feedstock with a lower concentration of impurities than the hydrocarbon feedstock and a residual feedstock with a higher concentration of impurities than the purified feedstock. Nevertheless, the concentration of impurities in the residual feedstock may be lower than the hydrocarbon feedstock. Additionally, catalytic treatment processes cannot typically process feedstocks with high concentrations of impurities in asphaltenes because of accelerated catalyst deactivation from the metals and micro-carbon residue.

Processes of the present technology produces a mixture that includes the converted feedstock and sodium salts. The present processes may further include separating the sodium salts from the converted feedstock. The sodium salts are comprised of particles, which can be quite fine (e.g., <10 μm) and cannot be completely removed by standard separation techniques (e.g., filtration or centrifugation). In any embodiments, the separating may include a. heating the mixture of sodium salts and converted feedstock with elemental sulfur to a temperature from about 150° C. to 500° C. to provide a sulfur-treated mixture comprising agglomerated sodium salts; and separating the agglomerated sodium salts from the sulfur treated mixture, to provide a desulfurized liquid hydrocarbon and separated sodium salts. This separation may be carried out as described in U.S. Pat. No. 10,435,631, the entire contents of which are incorporated by reference herein for all purposes.

The present processes may further include recovering metallic sodium from the separated sodium salts. In any embodiments, the present processes may further include electrolyzing the separated sodium salts to provide sodium metal. The separated sodium salts may comprise one or more of sodium sulfide, sodium hydrosulfide, or sodium polysulfide. The electrolyzing may be carried out in an electrochemical cell in accordance with, e.g., U.S. Pat. No. 8,088,270, or U.S. Provisional Patent Application No. 62/985,287, the entire contents of each of which are incorporated by reference herein for all purposes. The electrochemical cell may include an anolyte compartment, a catholyte compartment, and a NaSICON membrane that separates the anolyte compartment from the catholyte compartment. A cathode comprising sodium metal is disposed in a catholyte in the catholyte compartment. An anode comprising the sodium salts are disposed in anolyte in the anolyte compartment. An electrical power supply is electrically connected to the anode and cathode. In any embodiments, the separated sodium salts are dissolved in an organic solvent prior to electrolyzing the salts to provide sodium metal.

Illustrative embodiments of processes of the present technology will now be described with reference to the flow diagrams of FIGS. 1-3. With respect to the purification and conversion system 10 of FIG. 1, the hydrocarbon feedstock 101, containing sulfur and asphaltene impurities as described herein (e.g., a sulfur content of at least 0.5 wt % (herein, "wt %" means "weight percent") and an asphaltene content of at least 1 wt %), is charged to reactor 120 (continuous or batch) along with effective amounts of sodium metal 103 and an exogenous capping agent 105 as described herein. The reaction may be carried out at elevated temperature and pressure as described herein and is typically complete within minutes to give a mixture 121 of sodium salts and converted feedstock. The converted feedstock includes a hydrocarbon oil with a sulfur content less than that in the hydrocarbon feedstock and an asphaltene content less than that in the hydrocarbon feedstock as described herein. Additionally, the proportion of asphaltenic sulfur to non-asphaltenic sulfur in the converted feedstock is lower than in the hydrocarbon feedstock. Optionally, the mixture 121 is transported from the reactor 120 to another vessel 130 where the sodium salts are agglomerated to particles large enough to be easily separated from the converted feedstock. Although any suitable agglomeration method may be used, agglomeration with elemental sulfur 107 at elevated temperature as described herein may be used. The resulting mixture 131 of agglomerated sodium salts, metals and converted feedstock may then be separated by any suitable process and device 140, such as by a centrifuge, to give the converted feedstock 141, free of metals 143 and sodium salts 145. Optionally, as described herein, the sodium salts 145 may be subjected to electrolysis in an electrolytic cell 150 with a sodium ion-selective ceramic membrane 152 such as a NaSiCON membrane to provide sodium metal 153 and elemental sulfur 157. The sodium metal 153 and elemental sulfur 157 may be reused as 103 and 107, respectively, in the present process.

In some embodiments of the present processes utilizing the purification and conversion system 10 of FIG. 1, the hydrocarbon feedstock 101 is a residual feedstock. The effective amount of sodium metal 103 may be a less than a stoichiometric amount of sodium metal to the sulfur content of the residual feedstock. The resulting converted feedstock 141 (also in mixture 121) comprises a hydrocarbon oil with a sulfur content less than that in the residual feedstock 121 and an asphaltene content less than that in the residual feedstock 121.

Figure 2:
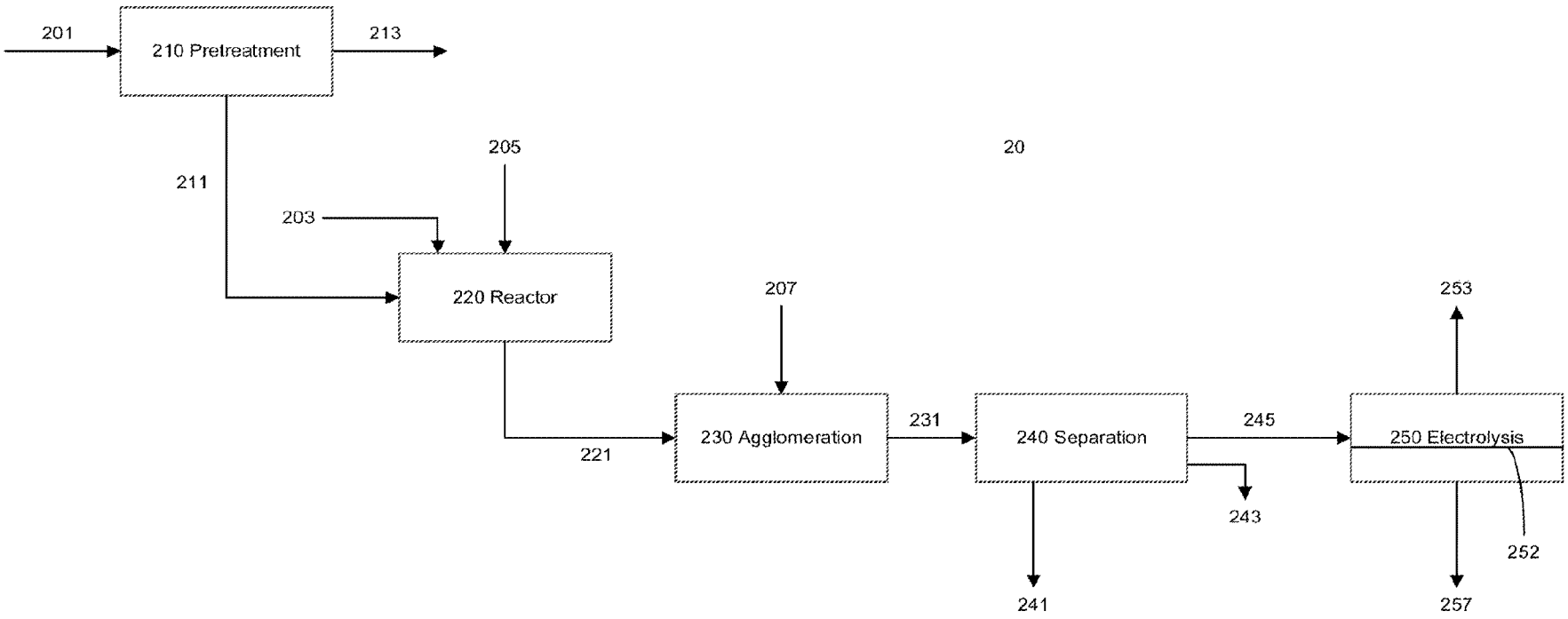
FIG. 2 shows a flow diagram for an illustrative embodiment of a process of the present technology including at least one pretreatment step.

FIG. 2 illustrates another process of the present technology using the purification and conversion system 20, wherein the impure hydrocarbon feedstock 201 is pretreated in a process/device 210 to provide a residual feedstock 211 and a purified feedstock 213, and optionally gaseous impurities 215 (e.g., $H_2S$, $H_2O$, $NH_3$ and light hydrocarbon gases). The purified feedstock 213 includes a lower concentration of impurities than the hydrocarbon feedstock 201 before pretreatment, and the residual feedstock 211 may include a higher concentration of impurities than the purified feedstock 213. The residual feedstock 211 includes hydrocarbons with a sulfur content of at least 0.5 wt % and an asphaltene content of at least 1 wt %. The pretreatment step may range from distillation of various types to hydrocracking, to solvent deasphalting, visbreaking, hydrotreatment, catalytic reforming and alkylation as described herein. In some embodiments, the pretreatment process comprises two steps in which the hydrocarbon feedstock is first converted to a single stream comprising the converted and purified feedstocks (e.g., by cracking) which may then be separated by, e.g., distillation.

The residual feedstock 211 is charged to a reactor 220, along with sodium metal 203 and an exogenous capping agent 205, analogous to the process illustrated in FIG. 1 and as described herein. The resulting mixture 221 of sodium salts and converted feedstock may be processed to agglomerate 230 and separate 240 the sodium salts 245 from the converted feedstock 241 as described herein. The converted feedstock 241 includes hydrocarbon oil with a sulfur content less than that in the residual feedstock 211 and an asphaltene content less than that in the hydrocarbon feedstock 201. Additionally, the proportion by weight of asphaltenic sulfur to non-asphaltenic sulfur in the converted feedstock 241 is lower than in the residual feedstock 211. Again, the sodium salts 245 may be electrolyzed 250 to provide sodium metal 253 and elemental sulfur 257 as described herein.

Figure 3:
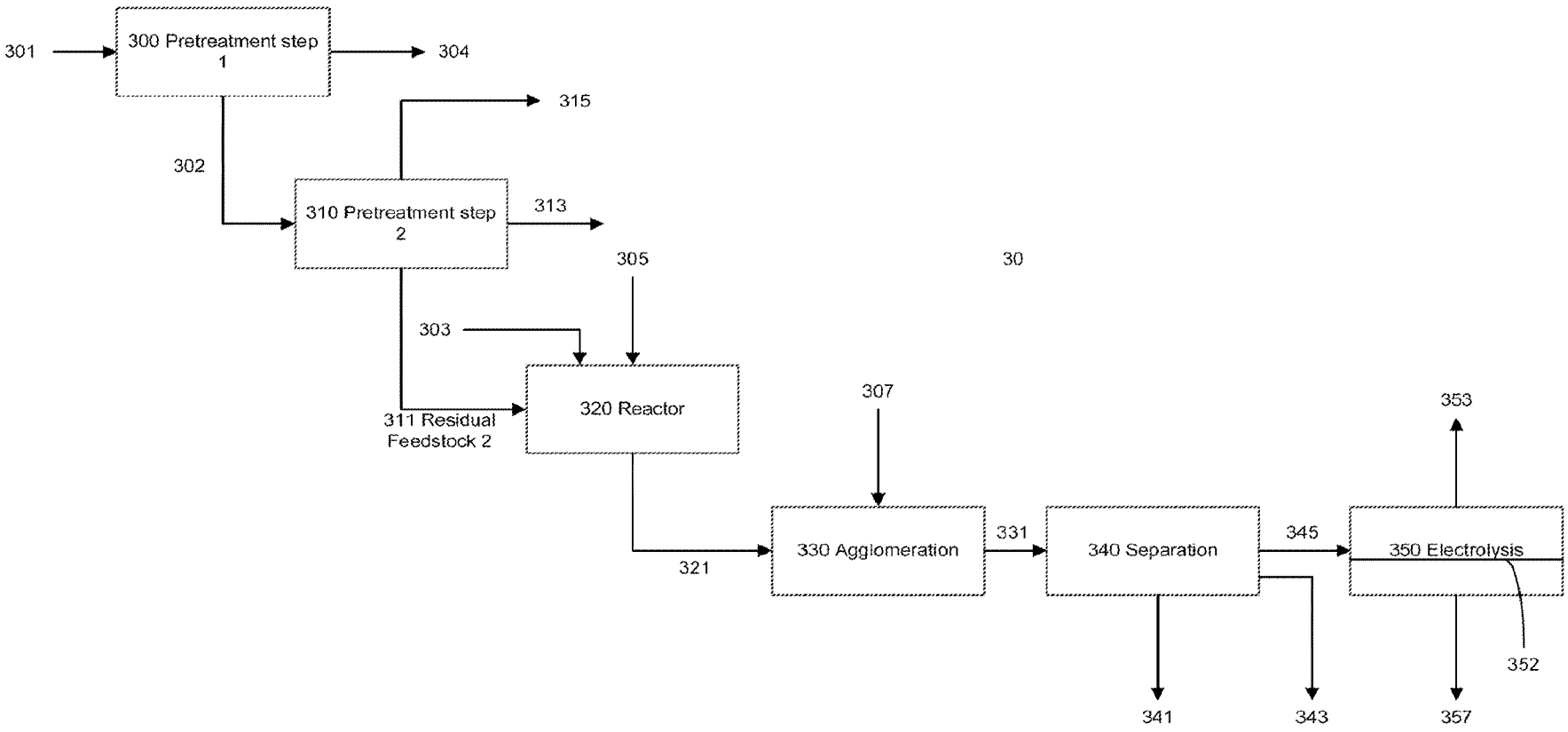
FIG. 3 shows a flow diagram for an illustrative embodiment of a process of the present technology including at least two pretreatment steps.

In some aspects and embodiments of the present processes, the pretreatment process may include two pretreatment steps employing the purification and conversion system 30 as shown in FIG. 3. Thus, the impure hydrocarbon feedstock 301 is subjected to a first pretreatment step/device 300. Any suitable pretreatment process resulting in a first residual feedstock 302 and a first purified feedstock 304 may be used as described herein. The residual feedstock 302 may be further pretreated (310) to provide a second residual feedstock 311 and a purified feedstock 313. Optionally, one or more impurities (e.g., gaseous impurities such as $H_2S$, $NH_3$, water, light hydrocarbons, etc.) may be removed in a separate stream during the first and/or second (as shown) pretreatment step. The second residual feedstock 311 may then be treated with sodium metal 303 and exogenous capping agent 305 in reactor 320 as described herein to provide a mixture 321 of sodium salts and converted feedstock. The sodium salts of mixture 321 may then be agglomerated (330) and separated (340) as described before to provide the converted feedstock 341, metals 343, and sodium salts 345. The sodium salts 345 may be electrolyzed in an electrolytic cell 350 with a sodium ion-selective ceramic membrane 352 (e.g., NaSiCON) as described herein to provide recovered sodium metal 353 and elemental sulfur 357.

EXAMPLES

Example 1—De-Sulfurization of Hydrocarbon Feedstocks with Sodium

A variety of hydrocarbon feedstocks were treated with sodium metal to demonstrate the wide applicability of sodium metal treatment for removing impurities and improving physical properties. The hydrocarbon feedstocks included virgin crude oils from different geographical locations and geological formations, and a variety of converted and treated feedstocks located within typical refining and upgrading facilities. 700 g of the hydrocarbon feedstock was treated with an appropriate mass of sodium in a 1.8 L Parr continuously stirred tank reactor using a batch or semi-batch system under the following conditions to yield a mixture of converted hydrocarbon and sodium salts. The reaction conditions, feed and product properties are shown in Table 1.

The results from Table 1 clearly indicate that molten sodium metal effectively removes impurities and improves the physical properties of the converted feedstock.

TABLE 1

| | Feedstock | | | | | | | | | |
|---|---|---|---|---|---|---|---|---|---|---|
| | Alberta Bitumen | | American VR | | Colombian VR | | Middle Eastern VR | | SDA Tar Blend | |
| Reaction Conditions | | | | | | | | | | |
| Temperature (C.) | 350 | | 350 | | 357 | | 358 | | 350 | |
| Pressure (psig) | 1500 | | 750 | | 1500 | | 1500 | | 750 | |
| Mole equivalents of sodium | 1.15 | | 1.35 | | 1.34 | | 1.13 | | 1.12 | |
| Residence Time | 60 | | 60 | | 60 | | 60 | | 60 | |
| Physical Properties | Feed | Product | Feed | Product | Feed | Product | Feed | Product | Feed | Product |
| Sulfur (wt %) | 4.50 | 0.50 | 3.40 | 0.03 | 3.90 | 0.01 | 5.10 | 0.02 | 5.00 | 0.04 |
| API Gravity | 8.3 | 17.8 | 1.2 | 4.3 | 5.8 | 13.3 | 4.71 | 8.3 | 6.3 | 13.1 |
| Density (kg/m3) | 1012 | 948 | 1066 | 1042 | 1031 | 977 | 1039 | 1012 | 1027 | 979 |
| Viscosity @ 50 C. (cSt) | 2,871,000 | 568 | 4,714,000 | 284,000 | 432,000 | 706 | 8,947,478 | 690 | 32,380 | 2,123 |
| Viscosity @ 80 C. (cSt) | | | | | | | | | | |
| Resid Cut (524 + C) | 50% | 35% | 90.0% | 83.0% | 75.9% | 52.3% | 92.3% | 40.4% | 70.0% | 63.0% |
| C5 Asphaltenes (wt %) | 10.7% | 1% | 25.0% | 16.0% | 14.1% | 3.6% | 23.3% | 10.9% | 16.8% | 6.6% |
| C7 Asphaltenes (wt %) | | | | | 20.1% | 13.9% | 14.2% | 4.8% | | |
| MCRT (wt %) | | | 35.0% | 28.0% | | | | | 28.3% | 19.5% |
| Vanadium (ppm) | | | 146 | 17 | 515 | 3 | 195 | 3 | 200 | 52 |
| Nickel (ppm) | | | 63 | 21 | 115 | 4 | 53 | 4 | 64 | 21 |
| Iron (ppm) | 289 | 5 | 56 | 13 | 629 | 7 | 252 | 7 | 51 | 3 |
| Total Metals (ppm) | | | 265 | 51 | | | | | 315 | 76 |
| Conversion Efficiency | | | | | | | | | | |
| Sulfur (wt %) | | 88.9% | | 99.1% | | 99.7% | | 99.6% | | 99.2% |
| Total Metals (ppm) | | 98.3% | | 80.8% | | 98.9% | | 97.2% | | 76.0% |
| C5 Asphaltenes (wt %) | | 90.7% | | 36.0% | | 30.8% | | 66.3% | | 60.7% |
| Product Quality Improvement | | | | | | | | | | |
| Density (kg/m3 per wt % S removed) | | 16.10 | | 7.22 | | 13.72 | | 5.25 | | 9.74 |
| Viscosity Reduction @ 50 C. (cSt) | | 2,870,432 | | 4,430,000 | | 431,294 | | | | 30,257 |
| Viscosity Reduction @ 50 C. (%) | | 100.0% | | 94.0% | | 99.8% | | | | 93.4% |

TABLE 1-continued

| | Feedstock | | | | | | | |
|---|---|---|---|---|---|---|---|---|
| | Asphaltenes | | Visbreaker Residue | | Hydrocracker Residue | | Hydroconversion Bottoms | |
| Reaction Conditions | | | | | | | | |
| Temperature (C.) | 358 | | 350 | | 350 | | 350 | |
| Pressure (psig) | 1500 | | 750 | | 750 | | 750 | |
| Mole equivalents of sodium | 1.07 | | 1.34 | | 1.35 | | 1.35 | |
| Residence Time | 60 | | 60 | | 60 | | 60 | |
| Physical Properties | Feed | Product | Feed | Product | Feed | Product | Feed | Product |
| Sulfur (wt %) | 8.20 | 0.02 | 2.00 | 0.30 | 3.80 | 0.30 | 2.40 | 0.50 |
| API Gravity | −11 | 13 | 9.3 | 12.3 | 3.9 | 9.2 | 8.9 | 12.5 |
| Density (kg/m3) | 1174 | 979 | 1005 | 984 | 1045 | 1006 | 1008 | 983 |
| Viscosity @ 50 C. (cSt) | N/A | | 1,944 | 656 | 501,200 | 27,980 | 658 | 375 |
| Viscosity @ 80 C. (cSt) | | | | | | | | |
| Resid Cut (524 + C) | 90.5% | 46.8% | 71.0% | 66.0% | 85.0% | 75.0% | 39.0% | 33.0% |
| C5 Asphaltenes (wt %) | 64.9% | | 11.0% | 8.2% | 17.0% | 11.0% | 7.9% | 5.6% |
| C7 Asphaltenes (wt %) | | | | | | | | |
| MCRT (wt %) | | 12% | 18.0% | 14.8% | 26.1% | 19.3% | 13.3% | 10.3% |
| Vanadium (ppm) | 675 | 5 | 40 | 7 | 192 | 50 | 140 | 45 |
| Nickel (ppm) | 201 | 18 | 41 | 11 | 115 | 40 | 67 | 24 |
| Iron (ppm) | 926 | 23 | 47 | 2 | 25 | 6 | 644 | 0 |
| Total Metals (ppm) | | | 128 | 21 | 332 | 96 | 3136 | 160 |
| Conversion Efficiency | | | | | | | | |
| Sulfur (wt %) | | 99.8% | | 85.0% | | 92.1% | | 79.2% |
| Total Metals (ppm) | | 97.5% | | 84.0% | | 71.1% | | 94.9% |
| C5 Asphaltenes (wt %) | | 100.0% | | 25.5% | | 35.3% | | 29.1% |
| Product Quality Improvement | | | | | | | | |
| Density (kg/m3 per wt % S removed) | | 23.84 | | 12.33 | | 11.25 | | 13.26 |
| Viscosity Reduction @ 50 C. (cSt) | | | | 1,288 | | 473,220 | | 283 |
| Viscosity Reduction @ 50 C. (%) | | | | 66.3% | | 94.4% | | 43.0% |

Example 2—De-Sulfurization of Hydrocarbon Feedstocks with Sodium

A variety of hydrocarbon feedstocks and residual feedstocks were treated with sodium metal in a pilot plant using a continuous system essentially as shown in FIG. 2 to further demonstrate the wide applicability of sodium metal treatment for removing impurities and improving physical properties during continuous operation. The hydrocarbon and residual feedstocks included virgin crude oil, vacuum residuums and partially converted feedstocks produced within typical refining and upgrading facilities. Each feedstock was treated with an effective amount of sodium in a 12 L continuously stirred tank reactor under the following conditions to yield a mixture of converted hydrocarbon and sodium salts. Hydrogen was the exogenous capping agent for all test campaigns. The reaction conditions, feed and product properties are shown in Table 2.

TABLE 2

| | Diluted Vacuum Residual | | Conventional Crude Oil | | Bitumen | | Vacuum Residual | | Hydroconversion Bottoms | |
|---|---|---|---|---|---|---|---|---|---|---|
| Reaction Conditions | | | | | | | | | | |
| Feed Oil Quantity (kg/hr) | 65.7 | | 65 | | 67.1 | | 50.5 | | 45.1 | |
| Sodium flow rate (kg/hr) | 2.1 | | 3.65 | | 5.69 | | 2.6 | | 1.69 | |
| Reaction Temperature (° C.) | 380 | | 360 | | 370 | | 360 | | 360 | |
| Pressure (psig) | 732 | | 749 | | 700 | | 749 | | 750 | |
| Mole equivalents of sodium | 1.24 | | 1.24 | | 1.29 | | 1.24 | | 1.24 | |
| Reactor Residence Time (min) | 4.6 | | 4.5 | | 4.3 | | 6.5 | | 6.7 | |
| Physical Properties | Feed | Product | Feed | Product | Feed | Product | Feed | Product | Feed | Product |
| API Gravity | 11.3 | 12.9 | 12.5 | 15.9 | 10.3 | 14.7 | 7.5 | 10.8 | 7.9 | 10.6 |
| Density (kg/m3) | 991 | 980 | 983 | 960 | 998 | 968 | 1018 | 994 | 1015 | 996 |
| Kinematic Viscosity (cSt @ 50° C.) | 650 | 374 | 603 | 254 | 2,308 | 492 | 191,500 | 21,510 | 1,075 | 592 |
| Kinematic Viscosity (cSt @ 80° C.) | 111 | 72 | 105 | 56 | 293 | 91 | 7,120 | 1,400 | 137 | 91 |
| Sulfur (wt %) | 1.76 | 0.49 | 3.14 | 0.48 | 4.57 | 0.49 | 2.88 | 0.61 | 2.1 | 0.51 |
| Iron (wppm) | 90 | 13 | 6 | 3 | 22 | 0 | 105 | 7 | 105 | 0 |
| Nickel (wppm) | 32 | 10 | 39 | 15 | 88 | 24 | 61 | 18 | 65 | 21 |
| Vanadium (wppm) | 69 | 23 | 100 | 43 | 240 | 59 | 123 | 53 | 85 | 19 |
| Total Metals (wppm) | 323 | 110 | 212 | 70 | 369 | 101 | 359 | 90 | 699 | 42 |
| Product Quality Improvement | Feed | Product | Feed | Product | Feed | Product | Feed | Product | Feed | Product |
| Density reduction (kg/m3 per wt % S removed) | | 8.65 | | 8.52 | | 7.36 | | 10.40 | | 12.13 |
| Viscosity Reduction @ 50° C. (cSt) | | 275 | | 350 | | 1,816 | | 169,990 | | 483 |
| Viscosity Reduction @ 50° C. (%) | | 42.4% | | 58.0% | | 78.7% | | 88.8% | | 45.0% |

Example 3: Preferential Removal of Sulfur in Asphaltene Fraction

A blended vacuum residuum stream was separately treated essentially as in Example 1 (batch), but with an increasing sodium to sulfur ratio (measured against 100% sulfur removal) in 5 separate experiments. 700 g of blended vacuum residuum was contacted with sodium at 350° C. and 750 psig of hydrogen partial pressure for 60 minutes. Key results are summarized in Table 3. The effect of treatment with sodium on preferential removal of sulfur from the asphaltene fraction is summarized by:

1. the fraction of total sulfur located in the asphaltenes was reduced from 28.5% to 7.9% of the converted product at a sodium to sulfur ratio of 0.94.
2. The proportion of sulfur in asphaltenes vs sulfur in non-asphaltenes is reduced as a function of increasing moles equivalents of sodium. The reduction in proportion demonstrates that a greater proportion of sulfur has been removed from sulfur containing asphaltenes than from non-asphaltenic sulfur at all practical sodium to sulfur ratios.

TABLE 3

| Removal of Sulfur from various oil fractions | | | | | | |
|---|---|---|---|---|---|---|
| | Sodium to sulfur ratio (mol equivalent of sodium) | | | | | |
| | Feed | 0.19 | 0.37 | 0.56 | 0.75 | 0.94 |
| Product Oil | | | | | | |
| Total Sulfur Content (wt % feed) | 2.17% | 1.92% | 1.63% | 1.31% | 1.01% | 0.70% |
| Total Asphaltene content (wt % feed) | 12.6% | 11.10% | 10.30% | 9.85% | 8.54% | 7.73% |
| Asphaltenic sulfur content (wt % of asphaltene) | 4.9% | 3.85% | 2.90% | 2.12% | 1.28% | 0.71% |
| Extent of Desulfurization | | | | | | |
| Overall (wt %) | — | 12% | 25% | 40% | 54% | 68% |
| Non-asphaltenic sulfur content (wt % of non-asphaltenic sulfur in feed) | — | 3.9% | 14.3% | 29.1% | 42.0% | 58.8% |
| Asphaltenic sulfur content (wt % of asphaltenic sulfur in feed) | — | 30.8% | 51.6% | 66.2% | 82.3% | 91.1% |
| Ratio of sulfur removed from Asphaltenes/non-asphaltenes (wt/wt) | — | 7.9 | 3.6 | 2.3 | 2.0 | 1.5 |
| Fraction of asphaltenic sulfur content in converted hydrocarbon (wt %) | 28.5% | 22.3% | 18.3% | 15.9% | 10.8% | 7.9% |
| Proportion of asphaltenic to non-asphaltenic sulfur (g/g) | 0.40 | 0.29 | 0.22 | 0.19 | 0.12 | 0.09 |

Example 4: Preferential Removal of Sulfur and Metals from the Asphaltene Fraction at Low Sodium/Sulfur Ratio Refinery intermediate streams (i.e., residual feedstocks) were treated essentially as in Example 1 (batch), but with a sub-stoichiometric molar equivalent of sodium to demonstrate preferential removal of sulfur and metals from the asphaltene fraction. 700 g of each refinery intermediate was treated with sodium at 350° C. and 750 psig or 400° C. and 1500 psig of hydrogen partial pressure for 60 minutes. A greater proportion of sulfur was removed from the asphaltene fraction in all cases. Additionally, the fraction of metals removed exceeds the fraction of total sulfur removed, indicating that a low sodium/sulfur addition ratio may be favorable to produce a partially converted product with low metals and asphaltene sulfur content for further processing in downstream refinery processes.

TABLE 4

| Asphaltene Conversion to Liquid Products | | | | |
|---|---|---|---|---|
| Feedstock | | Blended Vacuum Residuum | Hydro-conversion Residue | Hydro-conversion Residue |
| Molar equivalent of Sodium | | 0.20 | 0.20 | 0.65 |
| Sulfur Removal (wt % of initial) | | | | |
| Total Sulfur | wt % | 19% | 17% | 47% |
| Non-Asphaltenic Sulfur | wt % | 7% | 12% | 40% |
| Asphaltenic Sulfur | wt % | 36% | 21% | 66% |
| Metals Removal (wt % of initial) | | | | |
| Iron | wt % | 100.0% | 99.4% | 98.0% |
| Nickel | wt % | 76.2% | 39.0% | 61.0% |
| Vanadium | wt % | 74.7% | 85.3% | 97.0% |
| Produced Solids | | | | |
| Mass of solids produced | g | 7.17 | 7.04 | 18.70 |
| Carbon Content of Solids | wt % | 5.0% | 9.8% | 16.1% |
| Mass of Carbon in solids | g | 0.38 | 0.69 | 3.00 |

TABLE 4-continued

| Asphaltene Conversion to Liquid Products | | | | |
|---|---|---|---|---|
| Feedstock | | Blended Vacuum Residuum | Hydro-conversion Residue | Hydro-conversion Residue |
| Asphaltene Conversion yield | | | | |
| Feed Properties | | | | |
| Mass of Feed | g | 700.00 | 700.00 | 700.00 |
| Asphaltene fraction | wt % | 12.6% | 15.5% | 15.1% |
| Mass of Asphaltenes | g | 88.20 | 108.50 | 105.70 |
| Product Properties | | | | |
| Mass of Product | g | 697.01 | 697.44 | 697.05 |
| Asphaltene fraction | wt % | 9.8% | 12.6% | 12.2% |
| Mass of Asphaltenes | g | 68.45 | 87.88 | 85.04 |
| Converted Asphaltenes | g | 19.75 | 20.62 | 20.66 |
| Sulfur removed | g | 1.37 | 1.19 | 2.36 |
| Losses to solids | g | 0.38 | 0.69 | 3.00 |
| Net conversion to liquid | g | 18.00 | 18.74 | 15.30 |
| Conversion yield (net of sulfur removed) | % | 97.9% | 96.5% | 83.6% |

Example 5: Removing Impurities Remaining in the Residual Feedstock after Pre-Treatment A hydrocarbon feedstock was pre-treated in a hydroconversion reactor at >350° C. and >1500 psig of hydrogen partial pressure in the presence of catalyst to produce a residual feedstock with 2.06 wt % S and 239 ppm V, Ni and Fe that were not removed during hydroconversion under severe operating conditions. 700 g of the hydroconversion residual feedstock was then contacted with sodium at 400° C. and 1500 psig of hydrogen partial pressure in a batch reactor (60 minutes residence time) essentially as in Example 1. Results are shown in Table 5. Treatment with sodium removed the sulfur content and metals content that could not be removed during hydroconversion. Additionally, sodium converted a portion of the asphaltene fraction to a converted hydrocarbon oil and removed a greater proportion of sulfur from sulfur containing asphaltenes than from non-asphaltenic sulfur. The converted feed, with lower metals, asphaltene and sulfur content can now be treated in catalytic conversion processes to produce high value products.

TABLE 5

| | Residual Feedstock (Hydroconversion Bottoms) | Converted Feedstock |
|---|---|---|
| Sulfur content | | |
| Total Sulfur (wt %) | 2.06 | 0.54 |
| Non-Asphaltene sulfur content (wt % of non-asphaltene) | 1.88 | 0.50 |
| Asphaltene sulfur content (wt % of asphaltene) | 3.10 | 0.35 |
| Proportion of sulfur in asphaltenes/non-asphaltenes (g/g) | 0.32 | 0.08 |
| Metals | | |
| Ni (ppm) | 63 | 15 |
| V (ppm) | 77 | 1 |
| Fe (ppm) | 99 | <1 |
| Asphaltene fraction (wt % of feed) | 15.10 | 12.80 |
| Asphaltene conversion to liquid product (wt % of asphaltene converted) | — | 45.60 |

Example 6—De-Sulfurization of Asphaltenes with Sodium

A solid asphaltene feedstock was produced by treating bitumen with a sufficient quantity of n-pentane. 350 g of asphaltenes were then mixed with 350 g of mineral oil and treated with sodium at 350° C. and 1500 psig. Key results are summarized in Table 6. The results from Table 4 clearly indicate that molten sodium metal effectively removes impurities and improves the physical properties of asphaltenes. Sulfur content was reduced by 97.4%, the 524° C. cut was reduced by over 48% and metals were reduced by >97%.

TABLE 6

Key results for desulfurization of asphaltenes with sodium

| Feedstock | Asphaltenes | |
|---|---|---|
| Reaction Conditions | | |
| Temperature (° C.) | 358 | |
| Pressure (psig) | 1500 | |
| Sodium/Sulfur Molar ratio | 1.07 | |
| Residence Time | 60 | |
| Physical Properties | Feed | Product |
| Sulfur (wt %) | 8.2% | 0.2% |
| API Gravity | −11 | 13 |
| Resid Cut (524+° C.) | 90.5% | 46.8% |
| C7 Asphaltenes (wt %) | 64.9% | |
| MCRT (wt %) | | 12% |
| Vanadium (ppm) | 675 | 5 |
| Nickel (ppm) | 201 | 18 |
| Total Metals (ppm) | 926 | 23 |

TABLE 6-continued

Key results for desulfurization of asphaltenes with sodium

| Conversion Efficiency | |
|---|---|
| Sulfur (wt %) | 97.2% |
| Total Metals (ppm) | 97.5% |
| Resid Cut (524+° C.) | 48.3% |
| Product Quality Improvement | |
| API Gravity (per wt % S removed) | 3.00 |

EQUIVALENTS

While certain embodiments have been illustrated and described, a person with ordinary skill in the art, after reading the foregoing specification, can affect changes, substitutions of equivalents and other types of alterations to the processes of the present technology and products thereof as set forth herein. Each aspect and embodiment described above can also have included or incorporated therewith such variations or aspects as disclosed in regard to any or all of the other aspects and embodiments.

The present technology is also not to be limited in terms of the particular aspects described herein, which are intended as single illustrations of individual aspects of the present technology. Many modifications and variations of this present technology can be made without departing from its spirit and scope, as will be apparent to those skilled in the art. Functionally equivalent methods within the scope of the present technology, in addition to those enumerated herein, will be apparent to those skilled in the art from the foregoing descriptions. Such modifications and variations are intended to fall within the scope of the appended claims. It is to be understood that this present technology is not limited to particular methods, feedstocks, compositions, or conditions, which can, of course, vary. It is also to be understood that the terminology used herein is for the purpose of describing particular aspects only, and is not intended to be limiting. Thus, it is intended that the specification be considered as exemplary only with the breadth, scope and spirit of the present technology indicated only by the appended claims, definitions therein and any equivalents thereof.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Likewise, the use of the terms "comprising," "including," "containing," etc. shall be understood to disclose embodiments using the terms "consisting essentially of" and "consisting of." The phrase "consisting essentially of" will be understood to include those elements specifically recited and those additional elements that do not materially affect the basic and novel characteristics of the claimed technology. The phrase "consisting of" excludes any element not specified.

In addition, where features or aspects of the disclosure are described in terms of Markush groups, those skilled in the art will recognize that the disclosure is also thereby described in terms of any individual member or subgroup of members of the Markush group. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents (for example, journals, articles and/or textbooks) referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims, along with the full scope of equivalents to which such claims are entitled.

What is claimed is:

1. A process comprising:

pretreating a hydrocarbon feedstock comprising impurities to provide a purified feedstock and a residual feedstock, wherein the purified feedstock comprises a lower concentration of impurities than the hydrocarbon feedstock before pretreatment, and the residual feedstock comprises a higher concentration of impurities than the purified feedstock; and contacting the residual feedstock with an effective amount of sodium metal and an effective amount of exogenous capping agent at a temperature of 250-500° C., to produce a mixture of sodium salts and a converted feedstock, wherein the residual feedstock comprises hydrocarbons with a sulfur content of at least 0.5 wt % and an asphaltene content of from 2 wt % to 40 wt %;

the sulfur content comprises asphaltenic sulfur and non-asphaltenic sulfur;

the converted feedstock comprises hydrocarbon oil with a sulfur content less than that in the residual feedstock and an asphaltene content less than that in the residual feedstock; and the proportion by weight of asphaltenic sulfur to non-asphaltenic sulfur in the converted feedstock is lower than in the residual feedstock.

2. A process comprising:

contacting a hydrocarbon feedstock with an effective amount of sodium metal and an effective amount of exogenous capping agent at a temperature of 250-500° C., to produce a mixture of sodium salts and a converted feedstock, wherein the hydrocarbon feedstock comprises hydrocarbons with a sulfur content of at least 0.5 wt % and an asphaltene content of from 2 wt % to 40 wt %;

the sulfur content comprises asphaltenic sulfur and non-asphaltenic sulfur;

the converted feedstock comprises hydrocarbon oil with a sulfur content less than that in the hydrocarbon feedstock and an asphaltene content less than that in the hydrocarbon feedstock; and the proportion of asphaltenic sulfur to non-asphaltenic sulfur in the converted feedstock is lower than in the hydrocarbon feedstock.

3. A process comprising:

contacting a residual feedstock, the residual feedstock comprising hydrocarbons with a sulfur content of at least 0.5 wt % and an asphaltene content of from 2 wt % to 40 wt %; with a less than stoichiometric amount of sodium metal to the sulfur content of the residual feedstock, and an effective amount of exogenous capping agent at a temperature of 250-500° C., to produce a mixture of sodium salts and a converted feedstock, wherein the stoichiometric amount of sodium metal to sulfur content is the theoretical amount of sodium metal required to convert all sulfur content in the residual feedstock to sodium sulfide;

the converted feedstock comprises a hydrocarbon oil with a sulfur content less than that in the residual feedstock and an asphaltene content less than that in the residual feedstock.

4. A process comprising:

pretreating a hydrocarbon feedstock comprising impurities to provide a purified feedstock and a residual feedstock, wherein the purified feedstock comprises a lower concentration of impurities than the hydrocarbon feedstock before pretreatment, and the residual feedstock comprises a higher concentration of impurities than in the purified feedstock;

contacting the residual feedstock with an effective amount of sodium metal and an effective amount of exogenous capping agent at a temperature of 250-500° C., to produce a mixture of sodium salts and a converted feedstock, wherein the residual feedstock comprises hydrocarbons with a sulfur content of at least 0.5 wt % and an asphaltene content of from 2 wt % to 40 wt %;

the converted feedstock comprises a converted hydrocarbon oil with a sulfur content less than that in the residual feedstock and an asphaltene content less than that in the residual feedstock; and at least a portion of the converted hydrocarbon oil derives from asphaltenes in the residual feedstock.

5. The process of claim 3 further comprising pretreating a hydrocarbon feedstock to provide a purified feedstock and the residual feedstock, wherein the purified feedstock comprises a lower concentration of impurities than the hydrocarbon feedstock before pretreatment, and the residual feedstock comprises a higher concentration of impurities than the purified feedstock.

6. The process of claim 1, wherein the pretreatment step comprises:

(a) phase separation by an externally applied field, separation by addition of heat, hydroconversion, thermal conversion, catalytic conversion, catalytic treatment, solvent extraction, solvent deasphalting or a combination of any two or more thereof; or (b) contacting the hydrocarbon feedstock with exogenous hydrogen and/or a catalyst to remove one or more of sulfur, nitrogen, oxygen, metals and asphaltenes.

7. The process of claim 1, wherein the hydrocarbon feedstock is or is derived from a virgin crude oil or a product of a thermal cracking process.

8. The process of claim 1, wherein the hydrocarbon feedstock is selected from the group consisting of petroleum, heavy oil, bitumen, conventional crude oil, shale oil, and oil shale.

9. The process of claim 1, wherein the residual feedstock comprises one or more of refinery intermediate streams, hydrocracker residue, hydroprocessing residue, FCC slurry, residual FCC slurry, atmospheric or vacuum residuums, solvent deasphalting tar, deasphalted oil, visbreaker tar, high sulfur fuel oil, low sulfur fuel oil, asphaltenes, asphalt, steam cracked tar, LC-Fining® residue, or H-Oil® residue.

10. The process of claim 1, wherein the hydrocarbon feedstock or the residual feedstock has a viscosity from 1 to 10,000,000 cSt at 50° C. and a density of 800 to 1200 kg/m3 at 15.6° C.

11. The process of claim 1, wherein the residual feedstock is a solid at room temperature.

12. The process of claim 1, wherein the residual feedstock has a higher concentration of impurities than the hydrocarbon feedstock.

13. The process of claim 3, wherein the sulfur content comprises asphaltenic sulfur and non-asphaltenic sulfur, and the proportion of asphaltenic sulfur to non-asphaltenic sulfur in the converted feedstock is lower than in the residual feedstock.

14. The process of claim 1, wherein the viscosity of the converted feedstock is reduced by at least 50 cSt at 50° C. or at least by 40%, and the density of the converted feedstock is reduced by about 5 to about 25 kg/m$^3$ per wt % of the reduction in sulfur content of the converted feedstock compared to the hydrocarbon feedstock or residual feedstock.

15. The process of claim 1, wherein the iron and vanadium content of the converted feedstock have been reduced by at least 40% compared to the hydrocarbon feedstock or residual feedstock.

16. The process of claim 1, wherein the nickel content of the converted feedstock has been reduced by at least 40% compared to the hydrocarbon feedstock or residual feedstock.

17. The process of claim 1, wherein at least 40% of the asphaltene content in the residual feedstock is converted to a liquid hydrocarbon oil in the converted feedstock.

18. The process of claim 1, wherein the asphaltene content is converted at least in part to paraffins.

19. The process of claim 1, wherein the exogenous capping agent is hydrogen, hydrogen sulfide, natural gas, methane, ethane, propane, butane, pentane, ethene, propene, butene, pentene, dienes, isomers of the forgoing or a mixture of any two or more thereof.

20. The process of claim 1, wherein the residual feedstock is combined with sodium metal at a pressure of about 500 psig to about 3000 psig.

21. The process of claim 1, wherein the reaction of residual feedstock with sodium metal occurs for a time from 1 minute to 120 minutes.

22. The process of claim 1, further comprising separating the sodium salts from the converted feedstock; wherein the separating comprises a. heating the mixture of sodium salts and converted feedstock with elemental sulfur to a temperature from about 150° C. to 500° C. to provide a sulfur-treated mixture comprising agglomerated sodium salts; and b. separating the agglomerated sodium salts from the sulfur treated mixture, to provide a desulfurized liquid hydrocarbon and separated sodium salts.

23. The process of claim 22 further comprising electrolyzing the separated sodium salts to provide sodium metal; and wherein the electrolyzing is carried out in an electrochemical cell comprising an anolyte compartment, a catholyte compartment, a NaSICON membrane that separates the anolyte compartment from the catholyte compartment, wherein a cathode comprising sodium metal is disposed in a catholyte in the catholyte compartment, an anode comprising the sodium salts are disposed in anolyte in the anolyte compartment, and an electrical power supply is electrically connected to the anode and cathode.

24. The process of claim 1, wherein the sodium salts comprise one or more of sodium sulfide, sodium hydrosulfide, or sodium polysulfide.

* * * * *